US010094121B2

(12) United States Patent
Van Luchene et al.

(10) Patent No.: US 10,094,121 B2
(45) Date of Patent: Oct. 9, 2018

(54) SLAT DEVICE

(71) Applicant: RENSON SUNPROTECTION-SCREENS NV, Waregem (BE)

(72) Inventors: Frederik Van Luchene, Zulte-Machelen (BE); Pieter Brabant, Rumbeke (BE); Koen Verfaillie, Rumbeke (BE); Bart Pieter Jules Abeel, Sint-Eloois-Winkel (BE); Thierry Veys, Deinze (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/516,887

(22) PCT Filed: Oct. 16, 2015

(86) PCT No.: PCT/IB2015/057957
§ 371 (c)(1),
(2) Date: Apr. 4, 2017

(87) PCT Pub. No.: WO2016/059607
PCT Pub. Date: Apr. 21, 2016

(65) Prior Publication Data

US 2017/0306630 A1 Oct. 26, 2017

(30) Foreign Application Priority Data

Oct. 16, 2014 (BE) ..... 2014/5014

(51) Int. Cl.
*E06B 7/08* (2006.01)
*E04F 10/10* (2006.01)
*E06B 9/36* (2006.01)

(52) U.S. Cl.
CPC ..... *E04F 10/10* (2013.01); *E06B 9/368* (2013.01)

(58) Field of Classification Search
CPC ..... E06B 9/04; E06B 9/0676; E06B 9/0638; E06B 9/368; E06B 9/364; E06B 9/367;
(Continued)

(56) References Cited

U.S. PATENT DOCUMENTS 2,179,882 A * 11/1939 Durre ..... E06B 9/302 160/169
2,556,352 A * 6/1951 Wellensiek ..... E06B 9/302 160/169
(Continued)

FOREIGN PATENT DOCUMENTS

DE 23 56 880 A1 6/1974
DE 29703007 U1 * 6/1998 ..... E06B 9/368
(Continued)

OTHER PUBLICATIONS

International Search Report dated Jan. 22, 2016.

*Primary Examiner* — Katherine W Mitchell
*Assistant Examiner* — Johnnie A. Shablack
(74) *Attorney, Agent, or Firm* — Symbus Law Group LLC; Clifford D. Hyra

(57) ABSTRACT

A slat device (1) comprising a plurality of slats (2) arranged parallel to one another, displacement means (9, 10) for displacing the slats (2) between and in a stacking zone and a sliding, and a guide profile (3), which is arranged on a lateral side of the slats (2), wherein a slat (2), on the said lateral side, is provided with a guide element (5), corresponding with the guide profile (3), for guiding the respective slat (2) relative to the corresponding guide profile (3, 6) during its displacement motion between and in the stacking zone and the sliding zone, such that the guide element (5) is rotatable over a certain angle relative to the guide profile (3)
(Continued)

about an axis according to the longitudinal direction of the guide profile (3).

8 Claims, 3 Drawing Sheets

(58) Field of Classification Search
CPC . E06B 9/362; E06B 7/08; E06B 7/082; E06B 7/086; E06B 7/096; E06B 7/094; E04F 10/08; E04F 10/10
USPC ..... 160/205
See application file for complete search history.

(56) References Cited

U.S. PATENT DOCUMENTS 2,642,018 A * 6/1953 Weeber ..... A01G 9/241 16/365
3,284,951 A * 11/1966 Shapiro ..... E06B 7/084 454/224
3,744,544 A * 7/1973 Wellensiek ..... E06B 9/302 160/169
3,763,606 A * 10/1973 Rindebong ..... E04D 3/28 52/222
4,571,897 A * 2/1986 Kerr ..... E04D 3/28 52/13
5,289,863 A * 3/1994 Schon ..... E06B 9/364 160/168.1 R
6,240,998 B1 * 6/2001 Miwa ..... E06B 9/364 160/168.1 V
6,405,782 B1 * 6/2002 Cheng ..... E06B 9/368 160/168.1 P
6,866,078 B1 * 3/2005 Lin ..... E06B 9/362 160/177 V
7,370,684 B2 * 5/2008 Padan ..... E06B 3/927 160/169
8,201,609 B1 * 6/2012 Kitterman ..... E05D 15/582 160/172 R
9,410,365 B2 * 8/2016 Hashemi ..... E06B 7/094
9,605,475 B2 * 3/2017 De Muelenaere ..... E04F 10/10
9,732,553 B2 * 8/2017 Rotchell ..... E06B 7/096
2003/0056326 A1 * 3/2003 Ko ..... A47H 13/00 16/336
2006/0113045 A1 * 6/2006 Padan ..... E06B 3/927 160/201
2008/0121351 A1 * 5/2008 Lin ..... E06B 39/36 160/177 V
2008/0210388 A1 * 9/2008 Padan ..... E06B 3/927 160/201
2009/0071612 A1 * 3/2009 Hung ..... E06B 9/364 160/174 V
2011/0041407 A1 * 2/2011 van de Bult ..... E06B 9/30 49/79.1
2014/0175240 A1 * 6/2014 Selzer ..... E04B 7/163 248/237
2015/0159430 A1 * 6/2015 Huang ..... A47H 1/04 160/168.1 P
2015/0368959 A1 * 12/2015 Holford ..... E06B 7/10 49/82.1
2017/0226746 A1 * 8/2017 Byszenski ..... E04F 10/10

FOREIGN PATENT DOCUMENTS

EP 1262624 A1 * 12/2002 ..... E06B 7/096
EP 1418307 A1 * 5/2004 ..... E06B 7/086
EP 2113627 A2 * 11/2009 ..... E06B 9/0638
EP 2180132 A1 * 4/2010 ..... E06B 9/0638
EP 2687647 A1 * 1/2014 ..... E04F 10/10
EP 2832949 A1 * 2/2015 ..... E06B 7/096
EP 2840220 A1 * 2/2015 ..... E06B 7/096
WO WO-2014002326 A1 * 1/2014 ..... E06B 9/302
WO WO-2014195916 A1 * 12/2014 ..... E04F 10/10
WO WO-2016059344 A1 * 4/2016 ..... E04F 10/10
WO WO-2016189449 A1 * 12/2016 ..... E04F 10/10
WO WO-2017178757 A1 * 10/2017 ..... E04F 10/10

* cited by examiner

SLAT DEVICE

This application claims the benefit of Belgian patent applications No. 2014/5014, filed Oct. 16, 2014, which is hereby incorporated by reference in its entirety.

FIELD OF THE INVENTION

This invention relates to a slat device comprising a plurality of slats arranged parallel to one another;

displacement means for displacing the slats between and in a stacking zone and a sliding zone;

a guide profile, which is arranged on a lateral side of the slats;

and a guide element, which corresponds with the guide profile and which on the said lateral side is provided on a said slat, for guiding this slat relative to the guide profile during its displacement motion between and in the stacking zone and the sliding zone.

BACKGROUND

A slat device of this type usually serves as a screen, typically for the at least partial screening of an opening, such as, for example, a door opening or frame opening or gate opening, etc. or for the screening of an outdoor area, such as, for example, a terrace canopy or a veranda roof, etc. In slat devices of this type, a plurality of slats are usually arranged parallel to one another, wherein these can extend over a defined surface. This surface can assume any position between the vertical and the horizontal and can even be of curved construction.

The slat devices to which this invention relates are provided with a displacement mechanism for displacing the slats between and in a stacking zone, wherein the slats—when these are almost all accommodated herein—are located almost all one against another, and a sliding zone, in which the slats can extend spread over at least a part of the surface.

In patent publications WO 2004/070156 A1, DE 297 03 007 U1, DE 2 356 880 A1 and patent application PCT/IB2014/062013 of the present Applicant, various such slat devices are described.

These slat devices respectively comprise a plurality of slats which are arranged parallel to one another and which at their ends are connected to a trolley provided with guide elements for guiding the trolley in a guide profile during the displacement motion of the corresponding slat between and in the stacking zone and the sliding zone. Typically, the slat is fitted by its shaft in this trolley. In these trolleys, displacement means, such as, for example, a nut for engaging on a rotatable spindle, and/or tilting means, such as, for example, a worm gear transmission for tilting the corresponding slat, can also be fitted.

A drawback of these slat devices is that the guides often impede the displacement of the slats. When the slat devices assume sizeable dimensions and/or when relatively large tolerances exist on the guide profiles and/or the guide elements, and/or when the slats are arranged at an inclination, the guide elements can even get jammed in the guides. This problem can be limited by providing rollers as guide elements on the trolleys, as described, for example, in DE 2 356 880 A1. In this way, compactness is forfeited, however.

The object of this invention is to rectify this problem in a more compact manner.

SUMMARY

This object of the invention is achieved by providing a slat device comprising a plurality of slats arranged parallel to one another;

displacement means for displacing the slats between and in a stacking zone and a sliding zone;

a guide profile, which is arranged on a lateral side of the slats;

a guide element, which corresponds with the guide profile and which is provided on a said slat on the said lateral side, for guiding this slat relative to the guide profile during its displacement motion between and in the stacking zone and the sliding zone;

wherein the guide element is rotatable over a certain angle relative to this guide profile about an axis according to the longitudinal direction of the guide profile.

In this way, deviations resulting from sizeable dimensions and/or tolerances and/or inclined placements can be easily absorbed by virtue of the guide element being rotatable over a certain angle relative to the guide profile.

More specifically, the guide profile can for this purpose be of convex or concave construction and the guide element can be of correspondingly concave or convex construction in order to provide these rotatably relative to each other.

Under a convex or concave shape of this type are also included shapes whose surface is not necessarily completely flat. Such a surface can be provided with relief and can be provided for example, over the length of the guide profiles, with one or more ribs and/or grooves. As long as the shape, viewed overall, is of substantially convex or concave construction, and such surfaces still enable the rotation of the guide element relative to the guide profile, the corresponding shape is regarded as convex or concave.

In an embodiment of this type, the said axis is then preferentially a virtual axis, wherein the rotation does not take place about a real axis, but by displacement of the corresponding convex and concave surfaces one over the other.

In the said existing slat devices, it is a further drawback that the trolleys determine the minimum spacing between the slats, so that in the stacking zone the slats cannot be brought closer together than this minimum spacing.

An additional object of this invention is to provide a slat device in which the slats can be stacked in the stacking zone more compactly than in the known slat devices, without forfeiting the quality of the guidance.

This additional object is achieved by providing a slat device comprising a plurality of slats arranged parallel to one another;

displacement means for displacing the slats between and in a stacking zone and a sliding zone;

a first guide profile, which is arranged on a lateral side of the slats;

a second guide profile, which is arranged on the said lateral side of the slats; wherein the slats are alternately provided on the said lateral side with a guide element, corresponding with the first guide profile, for guiding the respective slat relative to the first guide profile during its displacement motion between and in the stacking zone and the sliding zone, and respectively with a second guide element, corresponding with the second guide profile, for guiding the respective slat relative to the second guide profile during its displacement motion between and in the stacking zone and the sliding zone.

By guiding the slats alternately relative to another guide profile, the necessary guidance can now be spread over two guide profiles. When the lengths which the guide elements assume for this purpose remain the same relative to the known slat devices, then, by spreading the guide elements alternately over the two guide profiles, the minimum spacing between the slats can be heavily reduced and, in principle, even halved, if other parts, such as, for example, displacement means or tilting means, allow this.

In order to be able to keep a slat device according to the invention as compact as possible on the lateral sides, the first-named guide profile and the second guide profile preferably form part of one and the same slat guide profile.

In a particularly compact embodiment, the slat guide profile then comprises an outer side and an inner side, wherein the outer side serves as the first-named guide profile and the inner side serves as the second guide profile.

Preferably, the second guide profile, just like the above-described guide profile according to this invention, which is of convex or concave construction, is likewise of convex or concave construction, wherein the corresponding second guide element, which is of correspondingly concave or convex construction, are rotatable over a certain angle relative to the second guide profile.

In a particularly preferential embodiment, a slat guide profile of a described slat device with slat guide profile then comprises a substantially C-shaped cross section, whereof the convex side serves as the first-named guide profile and the concave side serves as the second guide profile, wherein the corresponding guide elements are rotatable over a certain angle relative to these guide profiles.

In a slat device of this type, a particularly compact slat guide profile is combined with the advantageous rotatability of the guide elements relative to the guide profiles.

In a slat device according to this invention, first and second guide profiles corresponding with the first-named and the second guide profile are further preferably arranged on the other lateral side of the slats, wherein each slat on its one lateral side is provided with a first-named guide element and on its other lateral side is provided with a said second guide element.

In a specific embodiment, the displacement means comprise a rotatable spindle and, for each slat, a nut which is fastened on the rotatable spindle and is displaceable between and in the stacking zone and the sliding zone in order to provide the slat displaceably between and in the stacking zone and the sliding zone.

The slats of a slat device according to this invention further preferably comprise a slat shaft. The slat device then preferably comprises tilting means, for tilting the slats about their slat shaft between an open position, in which a gap extends between the slats, and a closed position, in which the slats together form a closed plane.

By rotating the slats between their closed position and their open position, light incidence, radiant heat and ventilation can thus be regulated towards a space screened by the slat device. By direction of the slats, sun and/or wind and/or precipitation can be blocked or precisely let through.

The tilting means of such a slat device then preferably comprise a drive shaft and, for each slat, a worm gear transmission which is drivable with the aid of the drive shaft.

In a yet more specific embodiment of a slat device having a said rotatable spindle, each said guide element forms part of a trolley, which comprises a mounting opening for a slat shaft, in which the corresponding slat can be fitted by its slat shaft, and which further comprises a nut holder, in which the nut corresponding with this slat can be fitted.

If this embodiment, moreover, comprises the said tilting means with worm gear transmission, then each such trolley which comprises a first-named guide element is then preferably provided with the worm gear transmission corresponding with the corresponding slat.

BRIEF DESCRIPTION OF THE DRAWINGS

This invention is now explained in greater detail on the basis of the hereinafter following detailed description of a preferential slat device according to this invention. The aim of this description is solely to provide illustrative examples and to indicate further advantages and particularities of this invention, and thus cannot be interpreted as a limitation of the field of application of the invention or of the patent rights claimed in the claims.

In this detailed description, reference is made by means of reference numerals to the hereto appended drawings, wherein in FIG. 1 an embodiment of a slatted roof according to this invention is represented at the level of the slats partially in cross section, cut through the guide profiles and channel profiles, and partially in elevation, with a view onto beams and columns and one of the slats.

DETAILED DESCRIPTION OF EMBODIMENTS

The depicted slat device (1) is a slatted roof (1). With similar characteristics, slat devices (1) can also be developed as screening for, for example, a door, frame or gate opening.

Figure 1:
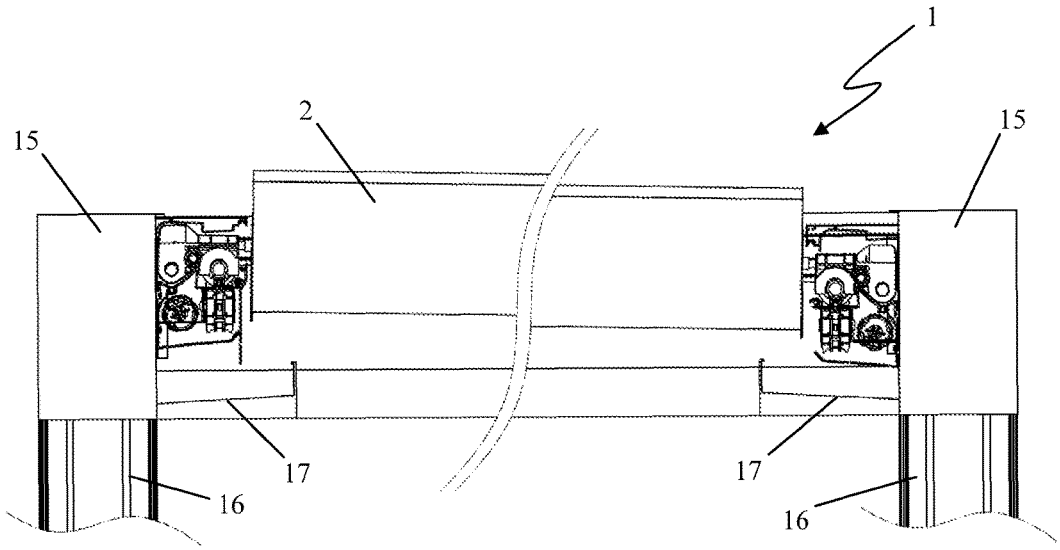
Figure 2:
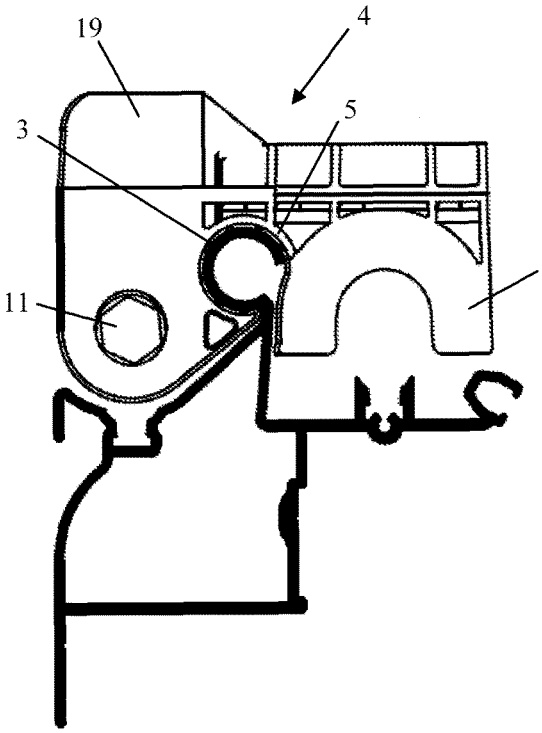
FIG. 2 guide profiles and a first trolley of the slat device from FIG. 1 are represented in elevation.
Figure 3:
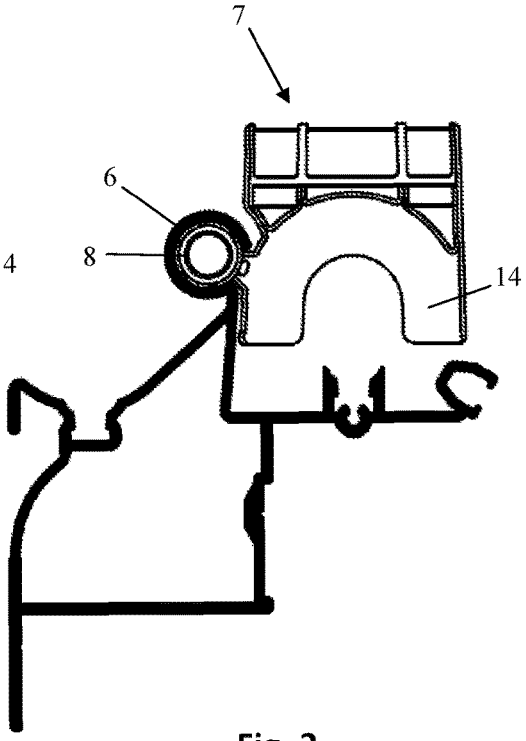
FIG. 3 guide profiles and a second trolley of the slat device from FIG. 1 are represented in front view.

The depicted slatted roof (1) comprises a plurality of slats (2), which are arranged parallel to one another. In the figures (see FIGS. 1 and 5), one of these slats (2) is depicted. These slats (2) are arranged rotatably about their slat shaft (12) (see FIG. 5), between an open position, in which a gap extends between the slats (2), and a closed position, in which the slats (2) together form a closed plane. Furthermore, these slats (2) are also movable in the said plane, between and in a stacking zone, in which the slats (2)—when these are almost all accommodated herein—are located almost one against another, and a sliding zone, wherein they together at least partially screen the said plane.

On both lateral sides of the slats (2), a side channel (17) is provided on a beam (15), for drainage of precipitation falling onto the slatted roof (1). The beam (15) and the side channel (17) extend almost transversely to the slats (2). The slats (2) are arranged at an inclination, sloping obliquely down towards a side channel (17), so that precipitation falling hereon is led off to this side channel (17). The beams (15) form with a front beam and a rear beam a framework in which the slats (2) extend and are supported by columns (16) in order thus to form a slatted roof (1) which, according to choice, can be arranged free from other construction. Alternatively, such a framework having slats (2) can be fastened, for example, also to an outside wall.

In order to provide the slats (2) in movable and tiltable arrangement, their slat shaft (12) is accommodated on both sides in a respective trolley (4, 7).

Figure 5:
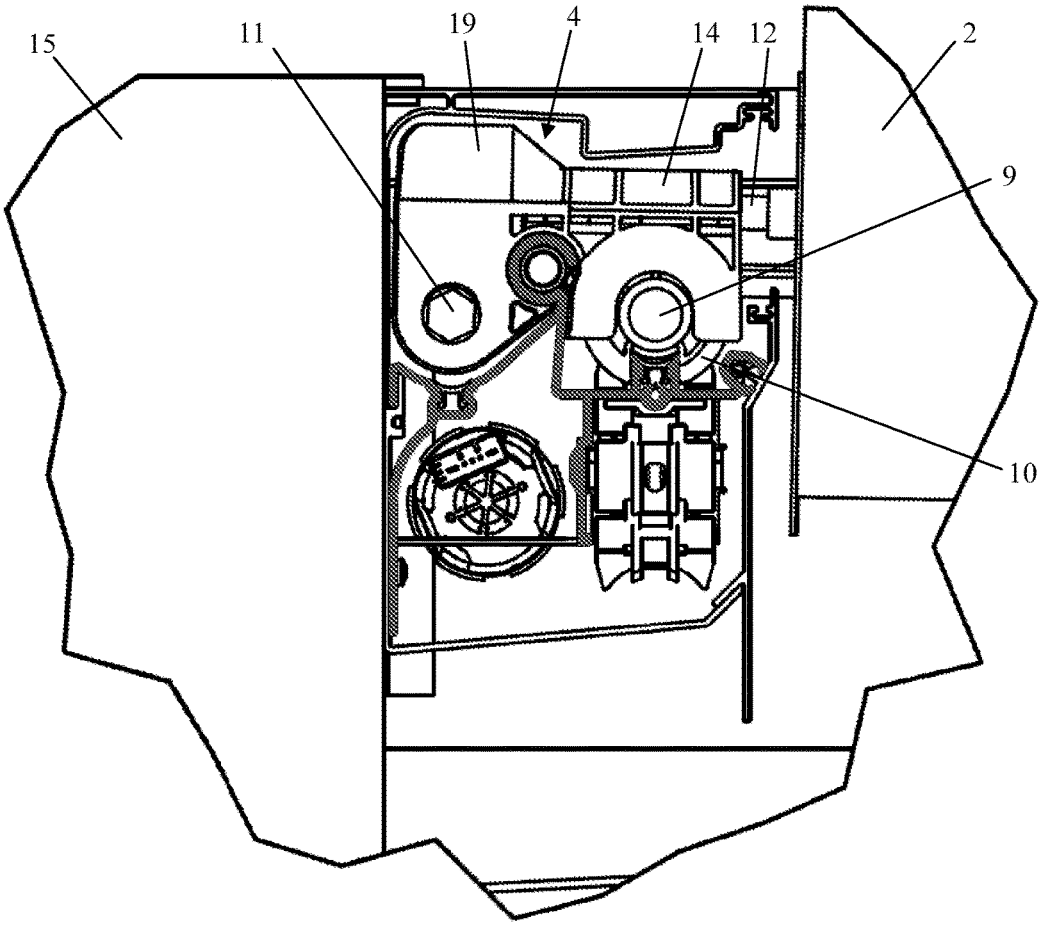
FIG. 5 a part of the slat device from FIG. 1 is represented in greater detail at the level of a lateral side of the slats.

In order to provide the slats (2) movably, each trolley (4, 7) is provided with a nut holder (14), in which is provided a nut (10) which is fitted around a rotatable spindle (9), as can be seen in FIG. 5. Such a spindle (9) is provided on both lateral sides of the slats (2), wherein the two spindles (9) are driven synchronously. By rotation of the spindles (9), the nuts (10) are displaceable between and in the stacking zone and the sliding zone. The nuts (10) hereupon transport the trolleys (4, 7), and thus also the slats (2), along with them in their movement. These nuts (10) and spindles (9) can here preferentially form part of a nut stacking mechanism as described, for example, in patent application PCT/IB2014/062013 of the present Applicant.

In order to guide the trolleys (4, 7) in their displacement motion, a slat guide profile (3, 6) is arranged on each lateral side of the slats (2) and each trolley (4, 7) comprises a corresponding guide element (5, 8).

In order to keep the guide (3, 5, 6, 8) of the trolleys (4, 7) compact and to provide the slats (2) such that they can be stacked as compactly as possible, two sorts of trolleys (4, 7) having two sorts of guides (3, 5, 6, 8) are provided.

Each slat (2) is provided on its one lateral side with a first trolley (4) and on its other lateral side with a second trolley (7). Successive slats (2) are provided on a same lateral side alternately with a first trolley (4) and a second trolley (7).

On both lateral sides of the slats (2), a same slat guide profile (3, 6) is arranged. This slat guide profile (3, 6) comprises a substantially C-shaped cross section, whereof the convex side serves as the first guide profile (3) and the concave side serves as the second guide profile (6). Over the first, convex guide profile (3), a corresponding first, concave guide element (5) of each first trolley (4) is movable. In the second, concave guide profile (6), a corresponding second, convex guide element (8) of each second trolley (7) is movable. In this way, the displacement motion of the slats (2) can be guided by movement of the respective guide elements (5, 8) relative to the respective guide profiles (3, 6).

Figure 4:
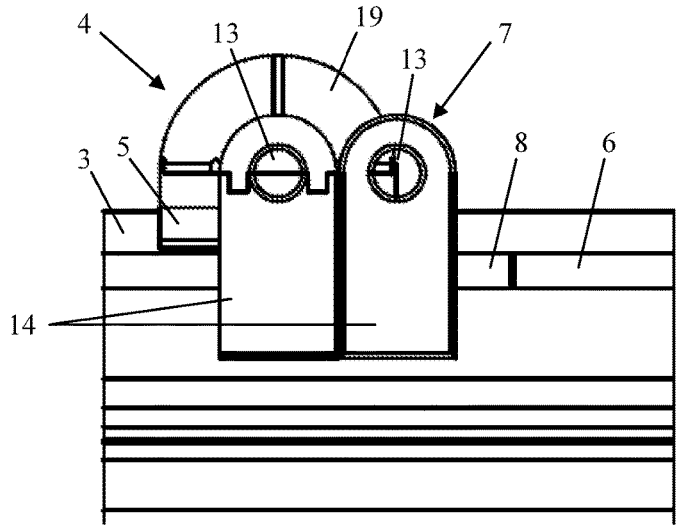
FIG. 4 guide profiles and trolleys of the slat device from FIG. 1 are represented in side view.
Figure 6:
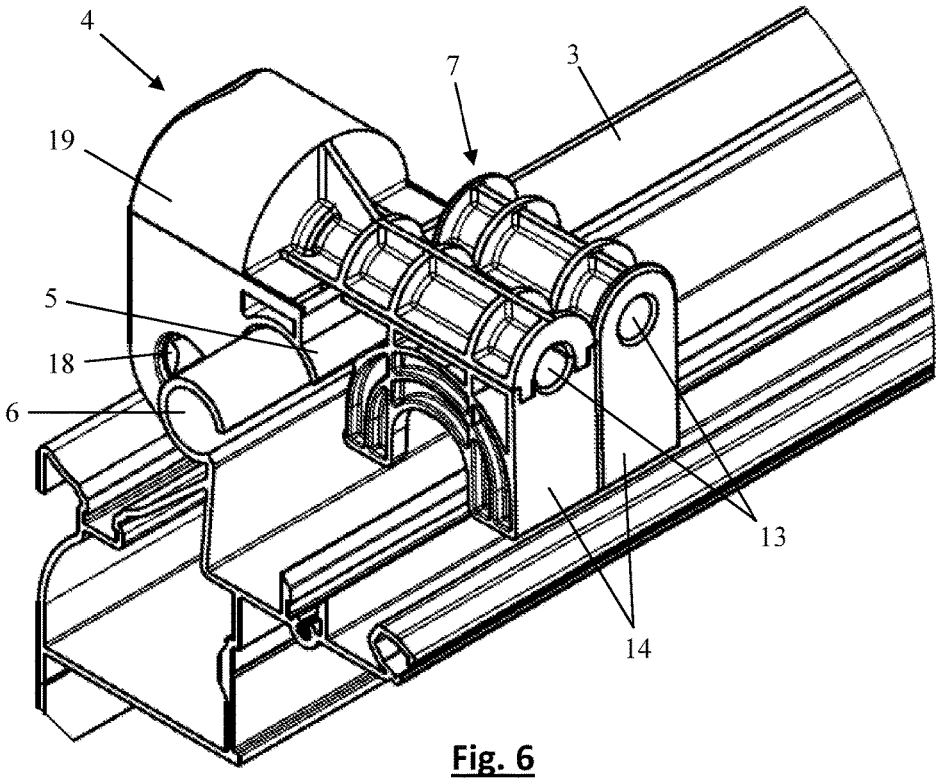
FIG. 6 guide profiles and trolleys of the slat device from FIG. 1 are represented in perspective, with a first and a second trolley in the stacking zone.
Figure 7:
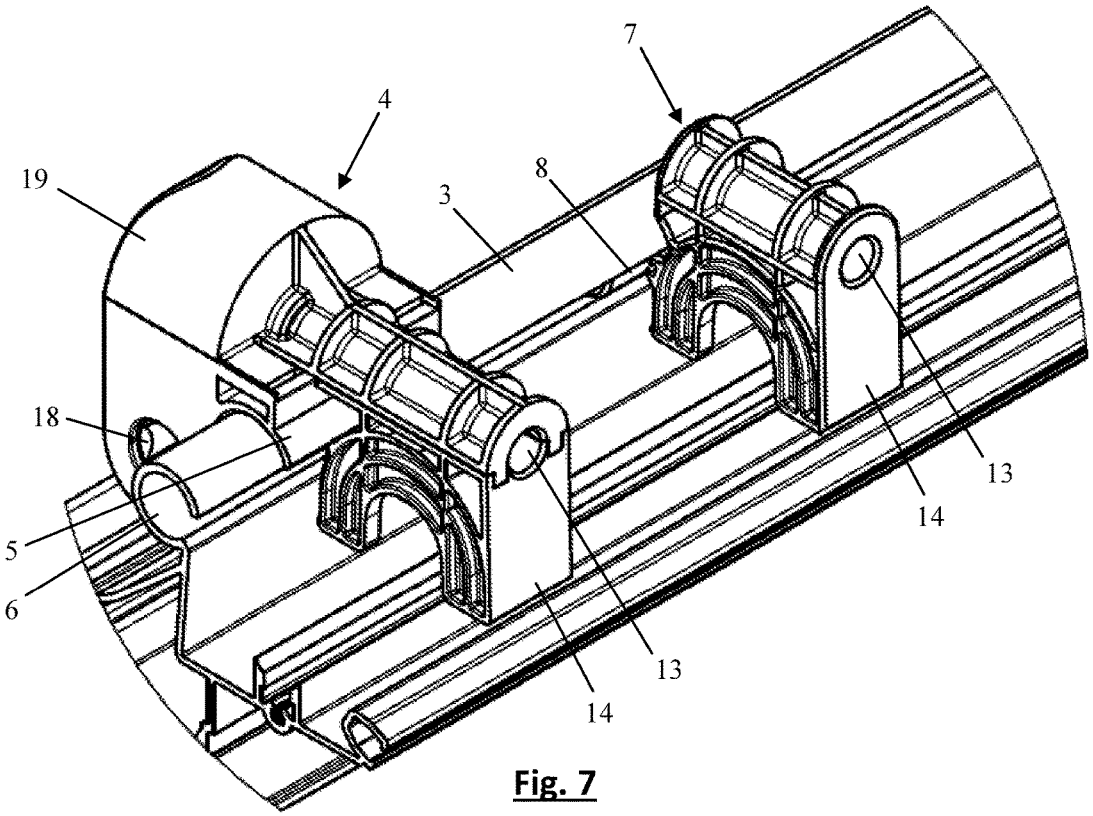
FIG. 7 guide profiles and trolleys of the slat device from FIG. 1 are represented in perspective, with a first and a second trolley in the sliding zone.

The length of the guide elements (5, 8) can here be chosen as a function of the guide and possibly be made longer than the corresponding dimensions of the trolleys (4, 7). Since the first guide elements (5) are guided relative to a different guide profile (3) from the second guide elements (8) and the various guide elements (5, 8) do not impede one another, with a same length of guide elements as in the prior art a more compact stacking of the slats (2) is possible than was hitherto the case, as can be seen in FIGS. 4 and 6.

As a result of its concave shape, corresponding with the convex shape of the first guide profile (3), each first guide element (5) is rotatable relative to the first guide profile (3) by movement of the concave shape of the guide element (5) over the convex shape of the guide profile (3). This rotation is limited to a certain angle around the virtual rotational axis about which the guide element (5) here rotates, this by the shaping of the guide profile (3) and the shaping of the first trolley (4) next to this guide element (5).

As a result of its convex shape, corresponding with the concave shape of the second guide profile (6), each second guide element (8) is rotatable relative to the second guide profile (6) by movement of its convex shape over the concave shape of the guide profile (6). This rotation is limited to a certain angle around the virtual rotational axis about which the guide element (8) here rotates, this by the shaping of the guide profile (6) and the shaping of the second trolley (7) next to this guide element (8).

In this way, the trolleys (4, 7) are not only movable relative to the slat guide profiles (3, 6), but are also tiltable over a certain angle relative to these slat guide profiles (3, 6). In this way, deviations resulting from sizeable dimensions and/or tolerances and/or inclined placements can be easily absorbed by virtue of the guide elements (5, 8) being rotatable over a certain angle relative to the slat guide profile (3, 6).

In order to provide the slats (2) rotatably, their slat shaft (12), on each lateral side, is rotatably fitted in a mounting opening (13) of the corresponding trolley (4, 7). The first trolleys (4) comprise a holder (19), in which a worm gear transmission is fitted. The worm gear is fitted around the slat shaft (12) and the worm is drivable with the aid of a drive shaft (11), which for this purpose is fitted through an opening (18) in the first trolley (4).

The holder (19) for the worm gear transmission of the first trolley (4) is arranged on the other side of the slat guide profile (3, 6) from the nut holder (14). The second trolleys (7) comprise no such holder (19), but only a nut holder (14). These second trolleys (7) extend only on that side of the slat guide profile (3, 6) where also the nut holders (14) of the first trolleys (4) are arranged. These nut holders (14) can be constructed more compactly than the holder (19) for the worm gear transmission, so that the slats (2) can hereby be stacked more compactly, as can be seen in FIGS. 4 and 6.

The invention claimed is:

1. A slat device comprising:

a plurality of slats arranged parallel to one another;

displacers for displacing the slats between and in a stacking zone and a sliding zone;

a first guide profile, which is arranged on a first lateral side of the plurality of slats;

at least one first guide element, which corresponds with the first guide profile and which one of said at least first guide element is provided on one of said plurality of slats on the first lateral side, for guiding said one of said plurality of slats relative to the first guide profile during its displacement motion between and in the stacking zone and the sliding zone;

wherein each first guide element is rotatable relative to the first guide profile about a virtual axis extending in a longitudinal direction of the first guide profile;

wherein the slat device comprises a second guide profile, which is arranged on the first lateral side of the slats, and in that the slats are alternately provided on the first lateral side with one of said at least one first guide element, and respectively with one of at least one second guide element, corresponding with the second guide profile, for guiding the respective slat relative to the second guide profile during its displacement motion between and in the stacking zone and the sliding zone;

wherein the second guide profile is of concave construction and each second guide element of a correspondingly convex construction and rotatable relative to the second guide profile;

wherein the first and second guide profiles together make up a slat guide profile which comprises a substantially C-shaped cross section, the convex side of which serves as the first guide profile and the concave side of which serves as the second guide profile.

2. The slat device according to claim 1, characterized in that the first guide profile is of convex construction and each first guide element is of a correspondingly concave construction and rotatable relative to the first guide profile.

3. The slat device according to claim 1, characterized in that additional first and second guide profiles are arranged on a second lateral side of the slats, opposite the first lateral side of the slats, and in that each slat on the second lateral side is alternately provided with one of said at least one first guide element and one of said at least one second guide element.

4. The slat device according to claim 1, characterized in that the displacers comprise a rotatable spindle and, in that each slat comprises a nut which is fastened on the rotatable spindle and is displaceable between and in the stacking zone and the sliding zone in order to provide the slat displaceably between and in the stacking zone and the sliding zone.

5. The slat device according to claim 1, characterized in that each of the slats comprises a slat shaft, and in that the slat device comprises one or more tilters, for tilting the slats about their slat shafts between an open position, in which a gap extends between the slats, and a closed position, in which the slats together form a closed plane.

6. The slat device according to claim 5, characterized in that the tilters comprise a drive shaft and, for each slat, comprise a worm gear transmission which is drivable with the aid of the drive shaft.

7. The slat device according to claim 6, characterized in that each said first and second guide element forms part of a corresponding one of a plurality of trolleys, which comprises a mounting for the respective slat shaft, in which the slat corresponding to the respective guide element can be fitted by its slat shaft, and which further comprises a nut holder, in which a nut corresponding to the corresponding slat can be fitted.

8. The slat device according to claim 7, characterized in that each trolley which comprises one of the first guide elements is provided with the worm gear transmission corresponding with the slat corresponding with the first guide element of the trolley.

* * * * *